US006454022B1

(12) United States Patent
Sangesland et al.

(10) Patent No.: US 6,454,022 B1
(45) Date of Patent: Sep. 24, 2002

(54) RISER TUBE FOR USE IN GREAT SEA DEPTH AND METHOD FOR DRILLING AT SUCH DEPTHS

(75) Inventors: Sigbjørn Sangesland, Trondheim; Hans Dynge, Kolsås, both of (NO)

(73) Assignee: Petroleum Geo-Services AS, Lysaker (NO)

( * ) Notice: Subject to any disclaimer, the term of this patent is extended or adjusted under 35 U.S.C. 154(b) by 0 days.

(21) Appl. No.: 09/509,084

(22) PCT Filed: Sep. 17, 1998

(86) PCT No.: PCT/NO98/00279

§ 371 (c)(1),
(2), (4) Date: May 22, 2000

(87) PCT Pub. No.: WO99/18327

PCT Pub. Date: Apr. 15, 1999

(30) Foreign Application Priority Data

Sep. 19, 1997 (NO) ..... 974348

(51) Int. Cl.[7] ..... E21B 7/128
(52) U.S. Cl. ..... 175/7; 175/5
(58) Field of Search ..... 175/5, 7

(56) References Cited

U.S. PATENT DOCUMENTS 4,063,602 A 12/1977 Howell et al.
4,091,881 A 5/1978 Maus
4,291,772 A 9/1981 Beynet

*Primary Examiner*—David Bagnell
*Assistant Examiner*—Sunil Singh

(57) ABSTRACT

A drilling riser for use at great sea depths for drilling of wells in the seabed using a drill string, with the drilling riser arranged to be connected between a wellhead at the seabed and a vessel, and arranged for use with a drilling fluid with sufficiently high density to balance the fluid pressure from the geological formations, with a sensor arranged to detect the level of the drilling fluid's level in the drilling riser, and a return riser pipe with an adjustable return riser pump. The return riser pipe extends up to the vessel, from an outlet on the riser, from a depth which is substantially below the sea surface, and at the same time at a height substantially above the seabed. The riser mud return pump is arranged by the outlet and arranged to adjust the drilling fluid level to a predetermined level by or above the outlet and substantially deeper than the sea surface, and that the drilling fluid has considerably higher density than what would be sufficient to balance the same fluid pressure from the geological formations by using a drilling fluid column entirely up to the surface, or to the vessel.

12 Claims, 5 Drawing Sheets

RISER TUBE FOR USE IN GREAT SEA DEPTH AND METHOD FOR DRILLING AT SUCH DEPTHS

CROSS-REFERENCES TO RELATED APPLICATIONS

This application claims priority under 35 USC §120 to PCT Patent Application No. PCT/NO98/00279 filed Sept. 17, 1998, and under 35 USC §119 to Norwegian Patent Application No. 97 4348, filed Sept. 19, 1997.

STATEMENT REGARDING FEDERALLY SPONSORED RESEARCH OR DEVELOPMENT

Not applicable.

BACKGROUND OF THE INVENTION

1. Field of the Invention

The invention concerns a drilling riser for use at great sea depths for oil drilling, and the application of this for controlling the riser margin, i.e. the overpressure being necessary to maintain in the drilling riser in order for a voluntary or nonvoluntary disconnection of the drilling riser not to lead to a blowout of gas, oil, formation liquids or other fluids.

Norwegian authorities, represented by The Norwegian Petroleum Directorate (NPD) normally require two independent pressure barriers during all drilling or well operations. However only one barrier is required, namely the drilling mud, until the surface casing, usually 20", is installed. When the operator's drilling program is evaluated, the requirement for a riser margin is carried out with the demand for two barriers. The riser margin is to be understood as:

"Hydrostatically exceeding pressure provided by an increased mud weight in order to compensate for the loss of hydrostatic pressure in the case of a sudden replacement of the mud column in the marine drilling riser with sea water (up to the sea surface level)."

The limitation for the riser margin is the pore pressure and the fracturing pressure of the rocks at the lower end of conductor pipes or the casings. If the mud pressure is higher than the pore pressure there is a risk of leaking of drilling mud into the geological formation, and lost circulation with a resulting risk of an uncontrolled blowout. If the riser margin is too low, a risk is present that the pore pressure in the rocks exceeds the hydrostatic overpressure in the mud after the drilling riser has been disconnected from the wellhead, a situation which also can result in an uncontrolled blowout.

Drilling liquid is used during oil well drilling for several reasons. The drilling liquid lubricates the drillstring so that power is not unnecessarily lost to an unwanted degree against the borehole wall, the borehole casing wall and the drilling riser. The drilling fluid also has high heat capacity and transports away heat which arises by friction during drilling, both from the drill bit, the borehole's bottom and wall, and also by friction arising between the drillstring and the casing and the drilling riser. The drilling liquid is circulated by pumping it down through the drill string, out through nozzles in the drillbit, and back up (out) again between the drill string's outside and the borehole wall, and further on the inside of the casing and through the blowout preventer and up into the drilling riser. The drilling riser comprises the connection between the blowout preventer on the seabed and the drilling vessel or drilling platform which (usually) floats at the sea surface. On the drilling vessel the drilling liquid is treated by filtering of cuttings and sand, and the density and the chemical composition is checked and adjusted before it is pumped down again into the borehole. The column of drilling fluid exerts a pressure p towards the borehole wall in every point according to the formula $$p=p_0+\rho_{m1}gh_m \quad (1)$$

where $\rho_{m1}$ is the density of the drilling liquid, g is the gravity acceleration and $h_m$ is the depth of drilling liquid below the surface of the drilling liquid. $p_0$ is an extra or optional static overpressure exerted on the drilling liquid at the surface, usually the atmospheric pressure.

The normal situation is to let the drilling liquid return out near the top of the drilling riser and lead it to recycling devices on board the drilling vessel, and further for reuse. Previous practices by letting the drilling liquid into the sea after use is no longer possible because of costs (except when the drilling liquid is sea water), aesthetical considerations and general care for the marine environment.

Handling and use of a 21" standard marine riser.

The operation and handling of a marine riser is problematic while drilling at large sea depths. Additionally the great volume of drilling fluid in the marine riser requires an extra storage capacity on the drilling vessel, normally 20 $m^3$ per 100 m of riser. At present only a few of fourth- or fifth generation drilling rigs are capable of operating and handling the weight of a 21" drilling riser at depths between 1000 and 1500 meters of water. These rigs are expensive and cost about 1,300,000 to 1,500,000 NOK/day. By replacing a part of the drilling mud in the 21" marine drilling riser with air, this will exert buoyancy in the part of the drilling riser which is emptied of mud. The return mud may be sent via a separate 4"–6" return mud pipe a device (pump) is put in place for artificially lifting the return drilling mud will reduce or eliminate several of the above mentioned limitations. Of one for instance reduces the mud level to a pump-out level 300 m below RKB one may pump out 20 $m^3$/100 m*300 m*2000 kg/$m^3$=120 000 kg=120 tons. Somewhat increased weight due to the mudpump itself and the mud in the return drilling riser must be accounted, but the reduction of weight is considerable.

2. Description of the Related Art

The idea itself, by arranging a separate return mud riser pipe with its own lift pump to return the drilling mud to the drilling vessel, is known as such. U.S. Pat. No. 4,063,602 describes a device for taking out the return mud via a T-pipe connection situated just above the blowout preventer. The purpose is to avoid the fracturing problems in the shallow geological formations when a high column of drilling mud is set up through the height of the riser at great water depths, during the start of the drilling at the seabed, and by relatively shallow drilling depth. From the T-pipe connection the drilling mud may be let out directly into the sea via a valve, and directly out on the seabed. Alternatively the drilling mud may be pumped up through a return pipe to the drilling vessel by means of a pump. The valve from the drilling riser to the T-pipe connection is controlled from the surface.

U.S. Pat. No. 4,063,602 granted in 1977 and U.S. Pat. No. 4,291,772 granted in 1981 both concern separate return riser pipes with pumps arranged near the wellhead valve at the seabed. The state of the art at that time was intended for drilling at far shallower sea depths than what the present invention is arranged for, and the solution with pumps arranged near the well valve at a depth between 1000 and 1500 meters being mentioned in the application as actual implementation depths of the invention, would imply a need for very long supply conductors for energy, and put extreme demands for leak-tightening of the mud return pumps and leak-proofing of pump engines.

U.S. Pat. No. 4,291,772 describes a drilling riser with connection of the return riser pipe at the wellhead, and an application of two separate fluids to maintain the correct mud pressure over the formations is described. One heavy fluid is circulated down via the inside of the drillstring and the return mud level is adjusted to stand in the drilling riser just above the wellhead by means of the return riser pipe and the return lift pump. The level for the heavy return mud in the drilling riser is adjusted by means of the pressure of the lighter fluid standing in the drilling riser. The lighter fluid may be mud, water or air. In order to maintain the pressure in the lighter fluid U.S. Pat. No. 4,291,772 prescribes application of a packer over the lighter fluid and below the kelley. This requires a blowout preventer valve below the kelley. U.S. Pat. No. 4,291,772 thus leads to severe problems when one shall a) change the diameter of the drillstring, b) send the drillbit through the blowout preventer and simultaneously maintain the riser margin, c) set down a casing string.

The different pipes and the drillbit shall firstly be led through the upper blowout preventer valve with a large pressure gradient, and then through the blowout preventer valve by the seabed. That solution becomes unproportionately expensive, difficult to implement and gives a huge time loss by change of drillbit and insertion of casing string.

U.S. Pat. No. 4,291,772 imposes risk of collapse of the drilling riser for the water depths for which the present invention is to be applied for. 21" drilling risers with 12 mm wall thickness have a collapse depth of about 600 meters water depth. At the time of granting of U.S. Pat. No. 4,291,772 it was hardly actual to drill on more than 600 meters sea depth. If one should base one's operation on U.S. Pat. No. 4,291,772 while drilling at more than 600 meters of water depth the risk of collapse would be immediate if one should happen to loose the air pressure below the upper blowout preventer valve. This would imply immediate collapse of the drilling riser and loss of the drilling riser and the drillstring. The same arguments are valid against U.S. Pat. No. 4,063,602 which also has the riser lift pump arranged near the seabed and which also has not been thought applied for the sea depths which now are actual for drilling.

Usually drilling risers of 21" diameter are applied. If the drilling mud level sinks inside the drilling riser below a certain level the water pressure will lead to collapse of the drilling riser at a given depth $D_k$, depending on the drilling riser's wall thickness t:

| $t$ | $D_k$ |
|---|---|
| 12 mm | 600 m |
| 16 mm | 950 m. |

A collapse of the drilling riser will lead to a risk of complete loss of the drilling mud above the blowout preventer valve. However automatic "fill-up" valves exist for letting in seawater into the drilling riser in order to avoid collapse of the drilling riser due to the surrounding pressure.

An emergency disconnection is not mentioned in the above mentioned patents.

If one wishes to avoid blowout, usually the above mentioned riser margin is applied by adjusting up the density of the drilling mud so that the sum of the pressure columns from the remaining drilling mud under the blowout preventer valve and the seawater down to the blowout preventer valve together may resist the pore pressure in all part of the borehole.

$$p=p_0+\rho_{m2}g(h_m31\ d_w)+\rho_w g(d_w) \quad (2)$$

With $\rho_{m2}$ as the new increased density of the drilling mud standing from the bottom of the borehole up to the blowout preventer valve, $d_w$ as the water depth, and $\rho_w$ as the density of sea water.

BRIEF SUMMARY OF THE INVENTION

The present invention concerns a drilling riser for use at great sea depths for drilling by means of a drillstring, of wells in the seabed, with the drilling riser being arranged for connection between a wellhead at the seabed and a vessel, and arranged for use with a drilling fluid with sufficiently high density to balance the fluid pressure from the geological formations, with a sensor arranged to register the level of drilling fluid in the drilling riser, and a return riser pipe with an adjustable mud return riser pipe pump. The new and inventive trait by this drilling riser is that the mud return riser pipe extends from the vessel down to an outlet on the drilling riser at a depth which is substantially below the sea surface, and that the return riser pipe mud pump is arranged near by the outlet and arranged for adjusting the drilling fluid level to a predetermined level near or above the outlet and substantially deeper than the sea surface, and that the drilling fluid has a considerably higher fluid density than what would be sufficient for balancing the fluid pressure from the geological formations by using a drilling fluid column extending all the way up to the sea surface or to the vessel. The invention also concerns a method for establishing a sufficient riser margin in the above mentioned drilling riser. The new and inventive step by the method is that the level of drilling fluid by means of the mud return riser pipe pump is held near or above the outlet, and that the density of the drilling fluid is kept considerably higher than what would be sufficient for balancing or exceeding the fluid pressure from the geological formations by using a drilling fluid column extending all the way up to the sea surface or the vessel, so that the sum of the hydrostatic pressures of the sea water and the remaining drilling mud below the wellhead after either a deliberate or involuntary disconnection of the drilling riser still would balance or be higher than the fluid pressure from the geological formations.

Further traits by the invention will emerge from the dependent claims.

The meaning of "a depth which is substantially below the sea surface, and at the same time at considerate height above the seabed" is a depth which preferably is about a hundred meters or deeper below the sea surface, and not as deep as the total water depth down to the seabed, but preferably several hundred meters above the seabed, except from the occasions where the sea depth is so shallow that the mud return riser pipe may be arranged just above the seabed.

Here follows given a closer description of the invention, with references to figure drawings where the invention has been illustrated.

DETAILED DESCRIPTION OF THE INVENTION

Figure 1:
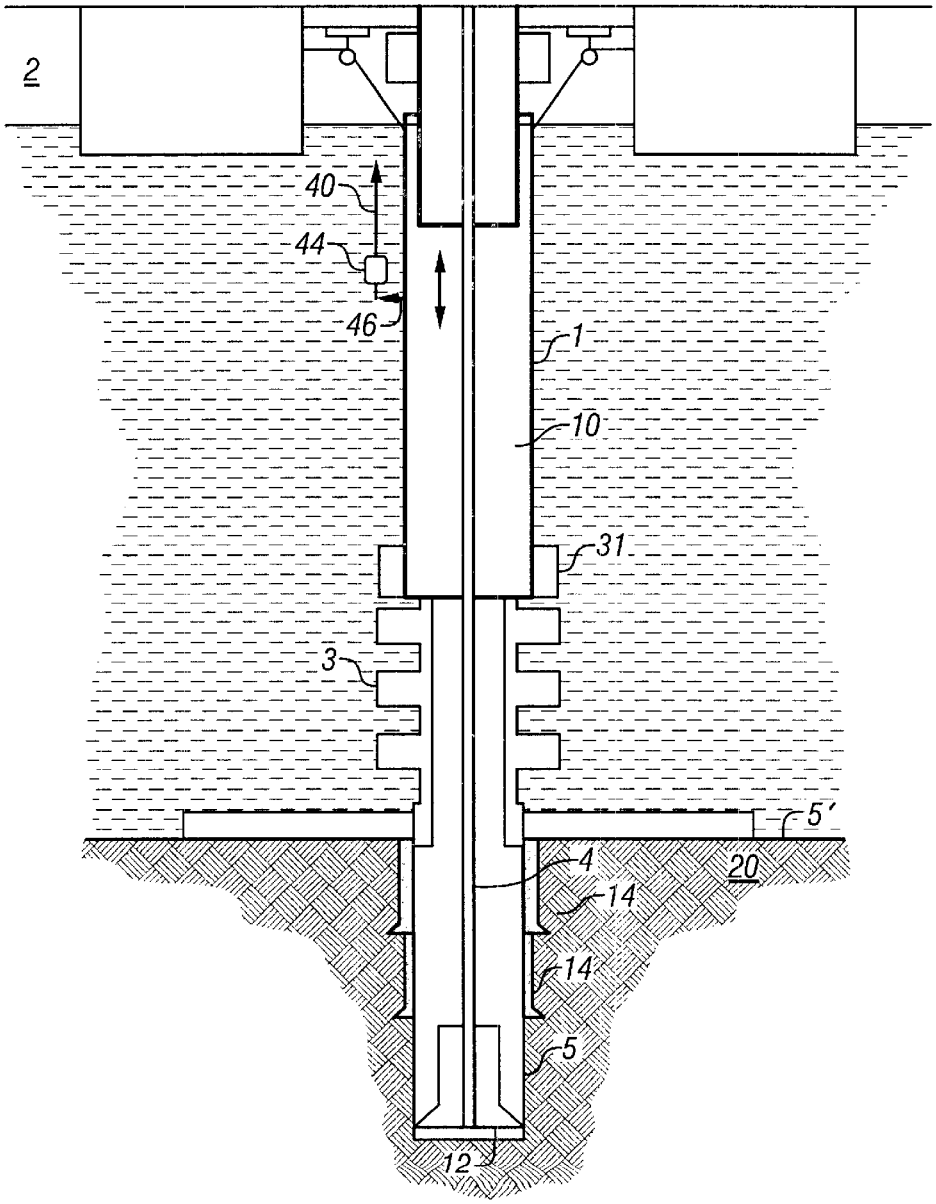
FIG. 1 displays an elevation view outline of the drilling riser, the drilling vessel and the seabed with borehole and wellhead with the blowout preventer valve.

FIG. 1 shows the main components of the whole system. A marine drilling riser 1 is arranged to be connected between a wellhead 3 and a drilling vessel 2. A drillstring 4 hangs from the drilling vessel 2 and down through the drilling riser and a blowout preventer valve BOP (not shown) in the wellhead 3 and further down in a borehole 5 in the rocks 20 below the seabed 5'. A wellhead connector 31 is assembled at the lower end of the drilling riser 1 and arranged to be connected to the top of the wellhead 3. Drilling mud 10 is filled down through the drillstring and returns after it has passed out through a drillbit 12 assembled at the lower end of the drillstring 4 and up through the borehole 5 and further up through the lined part of the borehole 5 between the outer surface of the drillstring 4 and the casing 14 in the borehole 5. The drilling mud rises by its own pressure up to an outlet 46 on the drilling riser where it is pumped by a pump 44 up through a return riser pipe 40 up to the drilling vessel 2. Above the drilling mud 10 in the riser there is open connection with the atmosphere and thus a relatively insignificant atmospherical pressure is exerted on top of the mud column 10.

Figure 2:
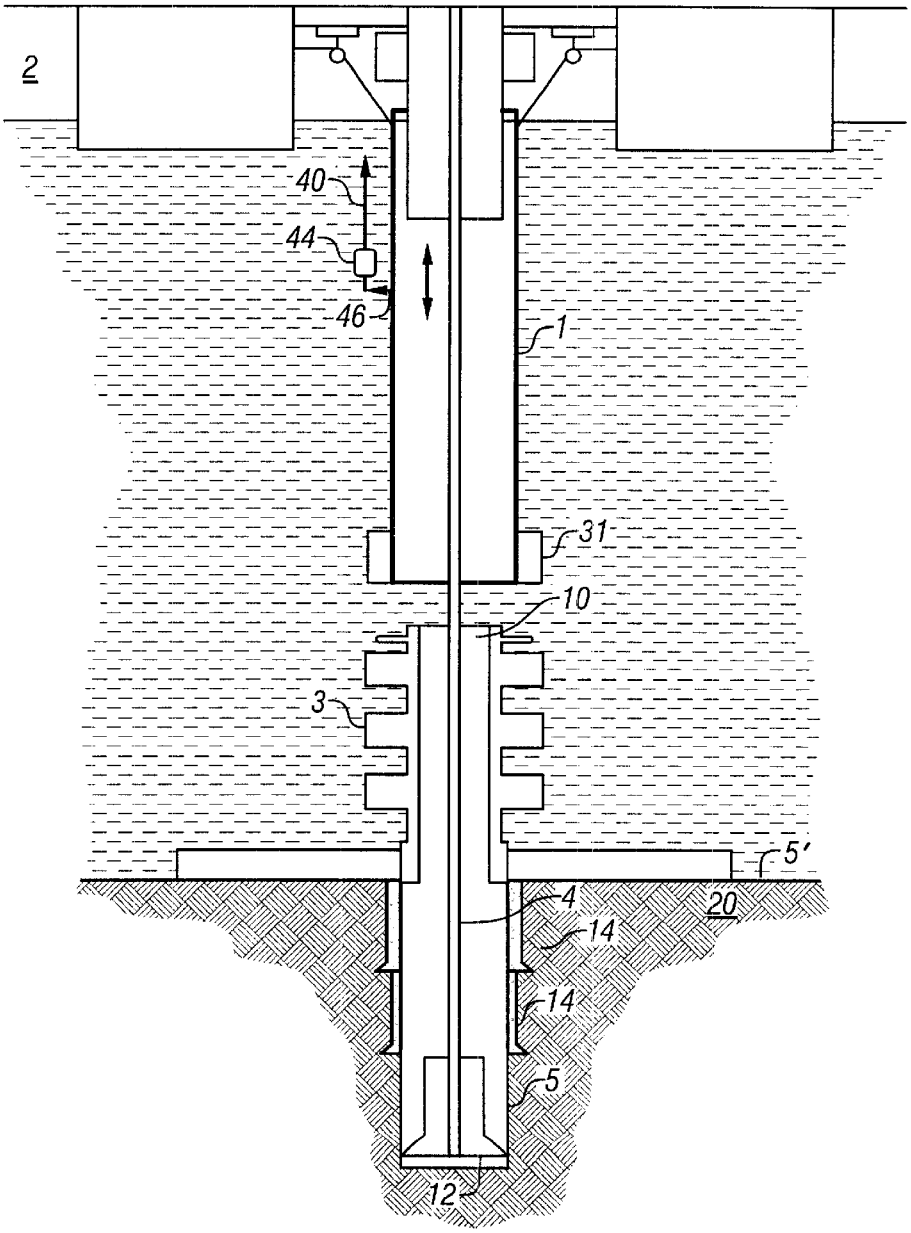
FIG. 2 shows the same as FIG. 1, but in a situation with the drilling riser disconnected from the wellhead and the blowout preventer valve at the top of the wellhead and where the riser margin has come into application in that the hydrostatic pressure from drilling mud and seawater exceeds the pore pressure of the rocks.

FIG. 2 displays the same items as FIG. 1, but with the difference that the drilling riser at its lower end is disconnected from the wellhead 3 by means of the wellhead connector 31. This situation may arise by deliberate or involuntary disconnection e.g. by bad weather, drilling vessel 2 going average, loss of fix position for the drilling vessel 2, breakdown of the drilling riser 1, or similar incidents which make the mud column between the wellhead 3 and the outlet 46 on the drilling riser disappear. The mud column is replaced by seawater inside the drilling riser 1. The pressure from the mud column 10 from the wellhead 3 and up to the outlet 46 is replaced by the pressure from the column of seawater between the wellhead 3 and up to the sea surface. If the density of the drilling mud is sufficiently high, the sum of the pressure of the seawater by the wellhead 3 together with the mud column extending from the bottom of the borehole 5 up to the wellhead 3 is sufficient to resist the pore pressure $P_p$ in the geological formations in the entire borehole.

Figure 3:
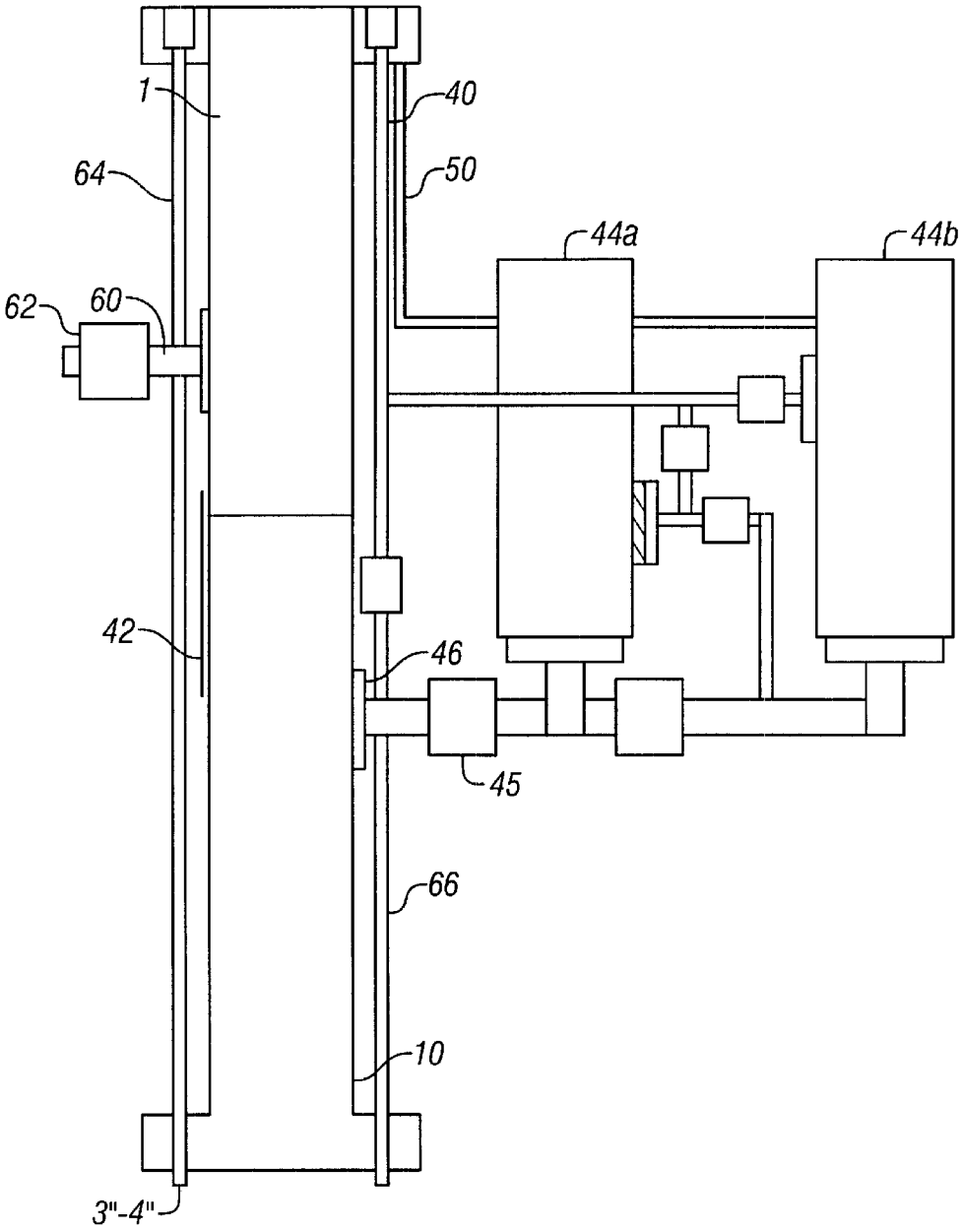
FIG. 3 is a principal outline in elevation view of the part of the drilling riser which comprises the outlet from the drilling riser to the return riser pipe and a mud return pump device and a level sensor for the drilling mud.

FIG. 3 shows that part of the drilling riser 1 with the mud outlet 46 to a remotely controlled valve 45 which is connected to the mud return pump 44 and along to the return riser 40. A conductor 50, preferably from the drilling vessel 2, provides energy to the mud return pump 44 to pump returning mud up to the drilling vessel 2. The return pump is preferably remotely controlled from the drilling vessel 2. The level for the returning mud 10 in the drilling riser 1 is monitored by means of a sensor 42. This sensor 42 is preferably assembled in the wall of the drilling riser but may according to the known art be also an ultrasonic sensor in the top or in the bottom of the drilling riser. An inlet 60 in the shape of a tube is assembled on the drilling riser 1. A filling valve 62 being arranged for remote control, is arranged above the level of the outlet 46 to the return riser pipe. The inlet 60 may, while the filling valve 62 is opened, be used in order to fill the drilling riser 1 partly or entirely with water in the purpose of increasing the liquid column height in the drilling riser 1, and thereby increasing the pressure in the liquid column of the drilling riser. This may be performed to prevent or halt a blowout.

Figure 4:
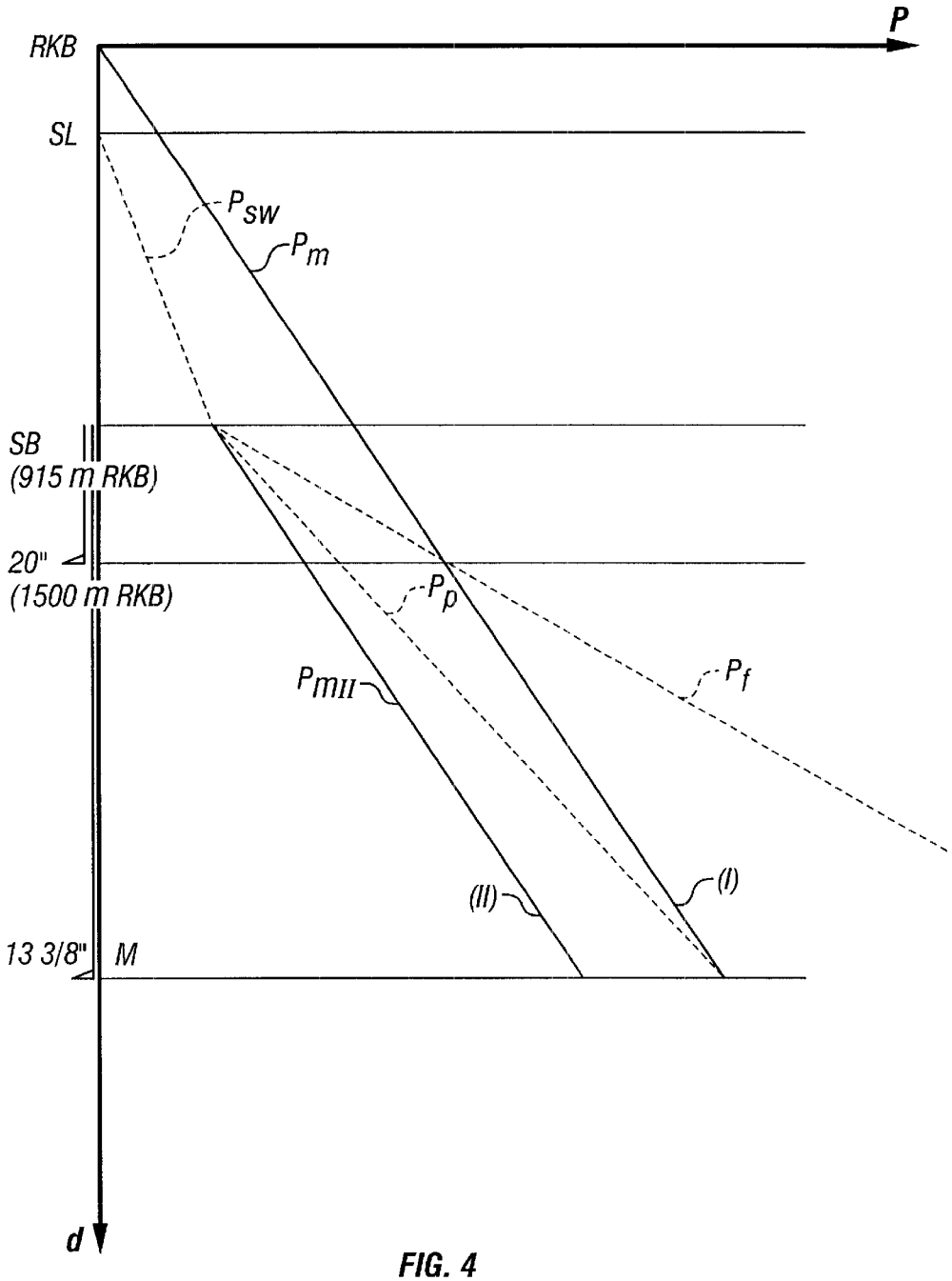
FIG. 4 are graphs in a Cartesian coordinate system which describe the borehole pressure before and after disconnection of the borehole drilling riser without the use of the present invention, which may imply a blowout.

FIG. 4 displays graphs of pressure with respect to the depth below sea level and RKB according to ordinary practice with the mud column standing entirely up to the RKB in the drilling riser. The graph $P_m$ illustrated the pressure of the drilling mud during ordinary conditions before disconnection of the drilling riser 1 from the wellhead 3 by means of the wellhead connector 31. The disconnection may be done on purpose or happen by accident. The graph $P_p$ shows the pore pressure in the pores between the mineral grains in the rock in the geological formations surrounding the borehole. $P_p$ must not be mistaken for the formation pressure $P_f$ comprising the lithostatic pressure exerted by the rock column with the sum of pressures from the various thicknesses of rocks with various densities over every single point at depth. If the pressure in the drilling mud $P_m$ exceeds the formation pressure $P_f$, the rocks will fracture (crack up). In FIG. 4, one may see that $P_m$ exceeds $P_f$ in the interval between the seabed (SB) and the 20" casing string's lower end. Below the casing string's lower end $P_m$ is less than the formation pressure or fracturing pressure $P_f$, and the rock will not fracture. FIG. 4 further displays the graph II for the pressure in the sea water $P_{sw}$ down to the seabed and the pressure in the drilling mud $P_{mII}$ from the seabed and down to the bottom of the borehole. Given the same density of the drilling mud the curves for $P_m$ and $P_{mII}$ are parallel in the cases I and II. The pore pressure as a function of the depth here is given by $P_p$. In this case the riser margin is insufficient, $P_{mII}$ is less than $P_p$, and thus the well is not sufficiently controlled when the pressure column above the seabed is lost.

For explanation of the abbreviations used in FIG. 4 and FIG. 5 we refer to the list below:

FIG. 4

RKB: Rotary Kelley Bushing level (drill floor reference level)

SL: Sea Level

SB: Sea bottom

20" Indicates bottom (setting depth) of 20" casing $13^{3/8}$" Indicates bottom(setting depth) of $13^{3/8}$n" casing $P_m$ Mud pressure $P_{sw}$ Sea water pressure $P_f$ Fracturing pressure $P_p$ Pore pressure I: Pressure in mud before disconnection of riser.

II: Pressure in mud after disconnection of riser;

$P_m \leqq P_p$, well control not OK.

M: Maximum setting depth for $13^{3/8}$" casing.

FIG. 5

RKB: Rotary Kelley Bushing level (drill floor reference level)

SL: Sea Level

SB: Sea bottom

20" Indicates bottom (setting depth) of 20" casing $13^{3/8}$" Indicates bottom(setting depth) of $13^{3/8}$" casing $P_m$ Mud pressure $P_{atm}$ Atmospheric pressure $P_{sw}$ Sea water pressure $P_f$ Fracturing pressure $P_p$ Pore pressure I': Pressure in mud before disconnection of riser.

II': Pressure in mud after disconnection of riser; $P_m \leqq P_p$, well control OK.

M': New and deeper maximum setting depth for $13^{3/8}$" casing.

Figure 5:
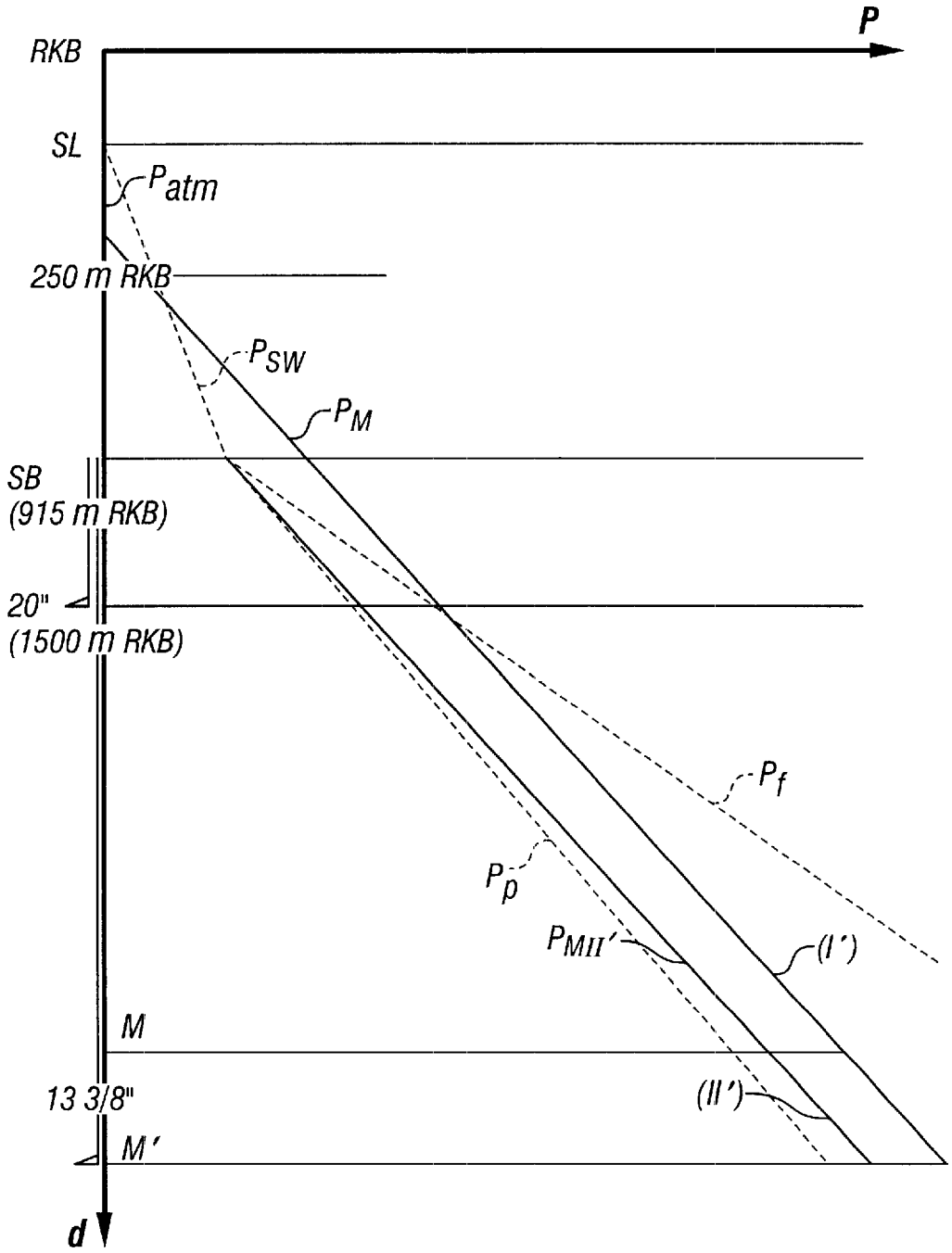
FIG. 5 are graphs in a Cartesian coordinate system which describe the borehole pressure before and after disconnection of the borehole drilling riser while using the present invention, something which may prevent blowout.

FIG. 5 displays pressure graphs according to the present invention. Here there is atmospherical pressure $P_{atm}$ down to the return riser pump, and below this the mud pressure. $P_m$ with the density $\rho_m$ higher than in the case described with FIG. 4. In this case the gradient of pressure becomes higher than in FIG. 4, and by a disconnection of the drilling riser at the wellhead this will give a pressure graph as shown by II'. That graph II' is situated between the formation pressure $P_f$ and the pore pressure $P_p$ and thus will give $P_{mII'}>P_p$, thus the well control is sufficient also after a disconnection of the drilling riser at the wellhead.

Usually drilling risers of 21" diameter are used, the next lower dimension is drilling risers of 16" diameter. Together with these riser pipe diameters belong the following diameters for BOP and wellhead:

| riser Ø | BOP Ø | wellhead Ø |
|---|---|---|
| 21" | 18¾" | 18¾" |
| 16" | 13⅜" | 13⅜" |

From the FIGS. 4 and 5 one may make the following presumptions about the drilling depth and the pressure relations: The gradient in pore pressure $P_p$ is higher than the gradient of the drilling mud pressure $P_m$. Before drilling down to the depth with $P_{p=Pm}$ one must insert a new casing (usually 13⅜" casing deeper than the previous 20" casing) irrespective of which gradients one work under. By the invention one obtains a higher mud pressure gradient and lower initial mud pressure by the seabed such that the intersection between the pressure graphs $P_p$ and $P_m$ will be situated lower. This implies that one is allowed to drill deeper before $P_p$ approaches $P_m$ to an extent that one must insert a new casing. This means that one totally needs fewer reductions in the casing diameter to reach a certain depth. The usual is to set 7" casing deepest. As a consequence of the above, one may say that one may start with a 16" drilling riser and begin with a slimmer casing string 14 and perform fewer reductions to narrower casing 14 than under the known art to obtain 7" diameter at the bottom, and at the same time obtain the same drilling depth or even deeper drilling depth due to the higher mud density simultaneously applied. A drilling riser with less diameter, e.g. 16" being the next standard diameter under 21" may be applied with the present invention. The volume of the 16" drilling riser is about 58% of the 21" drilling riser, and is thus substantially lighter.

The sensor 42 which may be a pressure sensor, acoustic sensor or similar is arranged substantially at the same height level in the drilling riser 1 as the outlet 46 to the return riser pipe mud pump 44 and the return riser pipe 40.

The pump device 44 may comprise two or several pumps 44*a*, 44*b* as shown in FIG. 3. The pumps may be connected such that they by means of a controller unit device (not shown) which by means of remotely controlled valves selectively may connect the pumps in series or in parallel. If one such pump may give a pressure of 30 bar, two pumps may be connected in series if one wishes to work with a higher pressure than 30 bar. If the work pressure shall be below 30 bar, one may connect two pumps in parallel and thus pump with approximately double capacity.

An inlet 60 may be arranged with a corresponding valve 62 in the drilling riser 1. This inlet may be applied if one wishes to fill seawater into the drilling riser above the mud column 10 in the drilling riser 1. This remotely controlled valve should be arranged at a height level situated above the outlet 46 to the return riser pipe 40. By letting in seawater above the fluid column one may increase the pressure in the borehole according to the water column above the inlet 60, and thereby have a pressure reserve as a backup.

In one embodiment of the invention the existing kill/choke-line pipes 64, 66 may be used as return riser pipes 40, as these are not used during normal drilling operation. In one embodiment one may arrange a separate return riser pipe 40 from the pump device 44 and up to the drilling vessel 2. In a preferred embodiment this is of a diameter 6"–8".

In table 1 calculations have been made for a drilling riser with depth 915 m below RKB. The calculations in the tables are made to illustrate the densities which would be applied on a typical oilfield. Column 6 shows which densities of the mud which would have been applied according to conventional drilling riser's construction. Column 7 shows which increased densities which may be applied with the invention, and column 8 displays the depth which one may lower down the mud column 10 to, in the drilling riser 1, by means of the present invention. By 1500–1900 m below RKB the reduction of mud level is as much as 336 meters.

TABLE 1

| Hole sectn. [inch] | Casing outer diam. [inch] | Casing setting depth D [m] | Hole section interval below RKB [m] | Circulation rate Q [l/min] | Maximum allow. fract. gradient in hole sect. [kg/l] | Requir. mud wght. to maint. suff. riser margin [kg/l] | Requir. reduct. in hydrost. head to avoid fract. of the fm. h [m] | Requir. Pump press. (hydrost. head + frict. loss (2) [bar] | Requir. pump power (75% efficy) [kW] |
|---|---|---|---|---|---|---|---|---|---|
| 36 | 30 | 1000 | 915 | 4500 | — | — | 1) | — | |
| 91.5 cm | 76.2 cm | | 1000 | | | | | | |
| 26 | 20 | 1500 | 1000 | 4500 | 1.10 | — | 1) | — | |

TABLE 1-continued

| Hole sectn. [inch] | Casing outer diam. [inch] | Casing setting depth D [m] | Hole section interval below RKB [m] | Circu-lation rate Q [l/min] | Maximum allow. fract. gradient in hole sect. [kg/l] | Requir. mud wght. to maint. suff. riser margin [kg/l] | Requir. reduct. in hydrost. head to avoid fract. of the fm. h [m] | Requir. Pump press. (hydrost. head + frict. loss (2) [bar] | Requir. pump power (75% efficy) [kW] |
|---|---|---|---|---|---|---|---|---|---|
| 66 cm | 50.8 cm | | 1500 | | | | | | |
| 17½ | 13⅜ | 1900 | 1500 | 4000 | 1.47 | | — | — | |
| 44.5 cm | 34 cm | | 1900 | | | 1.75 | 336 | 67 | 595 |
| 12¼ | 9⅝ | 2320 | 1900 | 3000 | 1.61 | 1.75 | 184 | 37 | 246 |
| 31 cm | 24.5 cm | | 2320 | | | 1.84 | 328 | 65 | 433 |
| 8 | 7 | 3200 | 2320 | 2000 | 1.71 | 1.84 | 190 | 37 | 160 |
| 20 cm | 18 cm | | 3200 | | | 1.83 | 244 | 47 | 209 |

1) N/A - Return of drilling fluid to sea bed
2) 6" ID return line

What is claimed is:

1. A drilling riser for use at great sea depth for drilling by means of a drillstring of wells in the seabed, said drilling riser arranged to be connected between a wellhead at the seabed and a vessel, for use with a drilling fluid at least partially filling the drilling riser and forming a drilling fluid column therein, with a sensor arranged to detect the drilling fluid's level in said drilling riser, and a return riser pipe extending between an outlet on said drilling riser and said vessel, said outlet situated at a depth being considerably below the sea surface and also being at a considerable height above the seabed, in which a pump device is disposed adjacent said outlet, arranged for pumping return drilling fluid up to said vessel and arranged to adjust said drilling fluid's level in said drilling riser to a predetermined level down to, or above said outlet, the riser comprising:

an inlet for seawater into said drilling riser disposed adjacent or above said outlet; and a valve on said inlet for selectively filling said drilling riser with seawater when the valve is opened.

2. The drilling riser of claim 1, in which said sensor is arranged substantially in a same height level in the drilling riser as said outlet on said drilling riser.

3. The drilling riser of claim 2, in which said sensor is a sensor selected from the group consisting of pressure depth sensors and acoustic depth sensors.

4. The drilling riser of claim 1, in which said pump device comprises at least two pumps.

5. The drilling riser of claim 4, in which said pumps are connected in series between said outlet and said return riser pipe.

6. The drilling riser of claim 4, in which said pumps are connected in parallel between said outlet and said return riser pipe.

7. The drilling riser of claim 1, in which there is an open connection to the atmosphere from the top of said drilling fluid column in said drilling riser.

8. The drilling riser of claim 1, in which existing kill/choke-line pipes are used as said return riser pipe.

9. The drilling riser of claim 1, in which said return riser pipe is separate from existing kill/choke-line pipes.

10. The drilling riser of claim 9, in which said return riser pipe has a diameter of between 6 and 8 inches.

11. A method for drilling at great sea depths by means of a drillstring, of wells in the seabed, in which a drilling riser is connected between a wellhead on said seabed and a vessel, with a drilling fluid at least partially filling the drilling riser and forming a drilling fluid column therein, with a sensor arranged to register said drilling fluid's level in said drilling riser, and a return riser pipe extending between an outlet from said drilling riser and said vessel, with said outlet arranged at a depth being substantially below the sea surface, and also being at a substantial height above the seabed, the method comprising:

adjusting said drilling fluid's level in the drilling riser to a predetermined level with respect to said outlet; and allowing seawater to enter through a valve arranged at an inlet in said drilling riser, said inlet disposed at or above said outlet.

12. The method according to claim 11, in which the drilling riser is not greater than 16 inches in diameter and is sustained with, until deeper drilled depth of the borehole, setting of casing down into the borehole.

* * * * *